United States Patent [19]

Sjöstrand

[11] 4,313,588

[45] Feb. 2, 1982

[54] CHRISTMAS TREE BASE OR THE LIKE

[75] Inventor: Gunnar Sjöstrand, Motala, Sweden

[73] Assignee: R. Hagga & Soner Aktiebolag, Soderkoping, Sweden

[21] Appl. No.: 128,813

[22] Filed: Mar. 10, 1980

[30] Foreign Application Priority Data

Mar. 15, 1979 [SE] Sweden ..... 7902340

[51] Int. Cl.[3] ..... F16M 13/00

[52] U.S. Cl. ..... 248/524; 248/316 E

[58] Field of Search ..... 248/519, 523, 524, 527, 248/528, 529, 539, 316 E; 24/263 SB

[56] References Cited

U.S. PATENT DOCUMENTS

| | | | |
|---|---|---|---|
| 848,850 | 4/1907 | Pissahl | 248/524 |
| 1,155,383 | 10/1915 | Tischer | 248/524 |
| 2,023,340 | 12/1935 | Peskulich | 248/524 |
| 2,242,270 | 5/1941 | Sims | 248/524 |
| 2,542,514 | 2/1951 | Harrell | 24/263 SB |
| 2,893,668 | 7/1959 | Applegate | 248/516 |
| 4,130,965 | 12/1978 | Patton | 248/524 X |

*Primary Examiner*—J. Franklin Foss

*Attorney, Agent, or Firm*—Cushman, Darby & Cushman

[57] ABSTRACT

A Christmas tree base or the like with a cross-shaped stand or the like, on the legs of which holders for the trunk or the like are provided, which by springs are capable to draw the holders to the center of the base. A cam disc is located centrally in the base. The cams of said disc upon rotation in one direction push the holders outward from the center. Upon rotation in the other direction, the springs draw the holders inward to the center whereby the holders with their upper portion abut the trunk. The holders are slidable on the legs with a certain play, so that a "chest drawer effect" arises upon abutment of the holders to the trunk and thereby locking is effected. The springs, therefore, can be dimensioned so small that the rotation of the disc in one direction or the other does not require much force, because the disc preferably is located in such a plane that it automatically neutralizes the action of the "chest drawer effect".

7 Claims, 5 Drawing Figures

CHRISTMAS TREE BASE OR THE LIKE

At Christmas most people probably have been confronted in one way or another with the problem to provide the Christmas tree with a base, which is capable to maintain the tree upright for several weeks.

Conventional Christmas tree bases requires a substantial amount of work to be carried out, either for adapting the wet, resiny, knotty and gnarled thick end of the tree to a round hole in a wooden cross by means of normally unsuitable edged tools, or for holding the tree upright while a helpmate is lying on the floor and tries to tighten three or four screws in order to prevent the tree from tilting over and falling out of the base. At the same time the centre of gravity of the tree must be positioned within the support area of the base, because otherwise both the tree and the base will tilt over. The energy required is in both cases substantial.

The present invention relates to a structure, which substantially is intended for use one year after the other as a Christmas tree base, but which, of course, also can be utilized for upright objects other than Christmas trees. The structure, for example, can be applied advantageously as a holder for torches or the like where easiness of attachment is required.

The device according to the invention is self-locking, and the mounting proper can be carried out by a single person who not necessarily must bow down to the floor level for locking the tree or the like in the base. The characterizing features of the invention become apparent from the attached claims.

Figure 1:
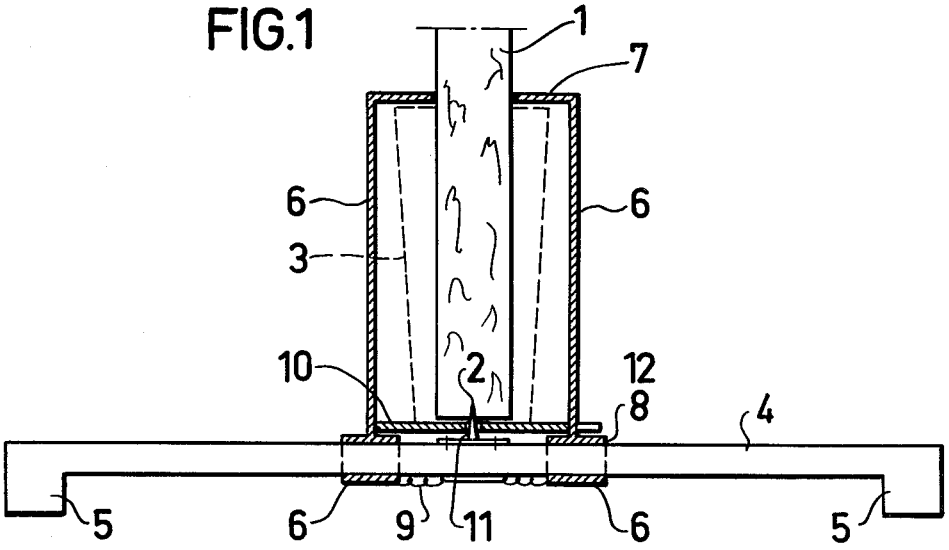
Figure 2:
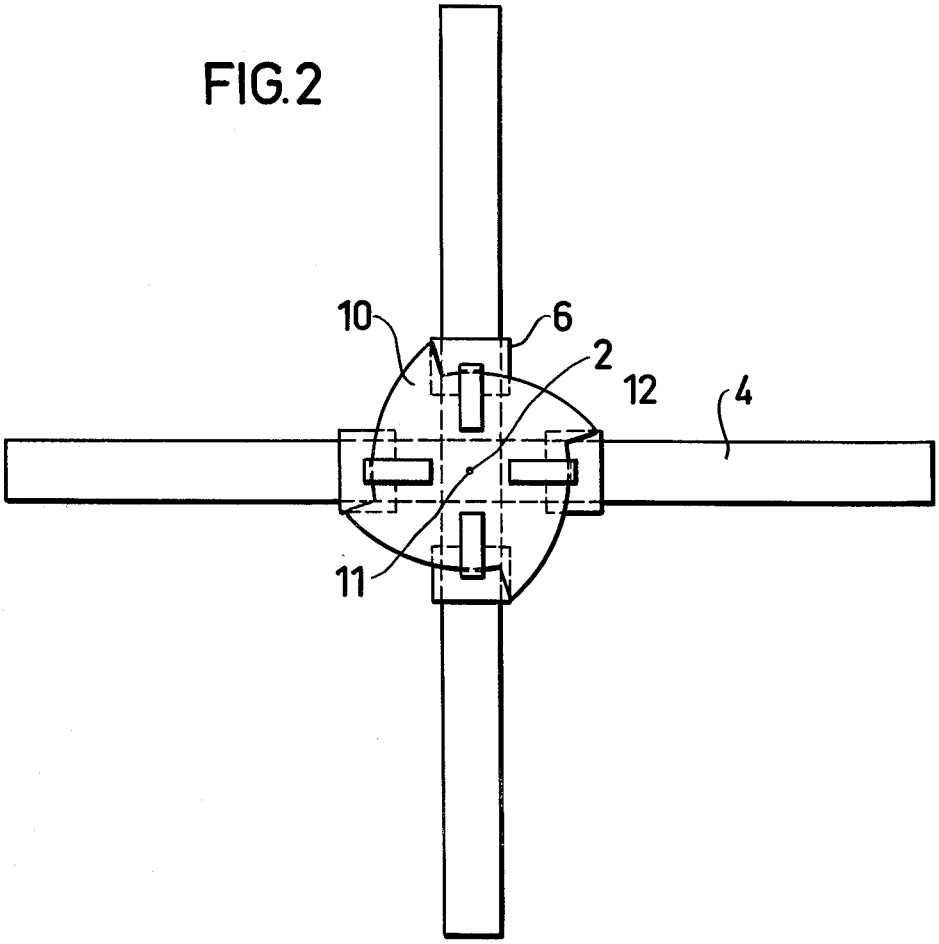
Figure 3:
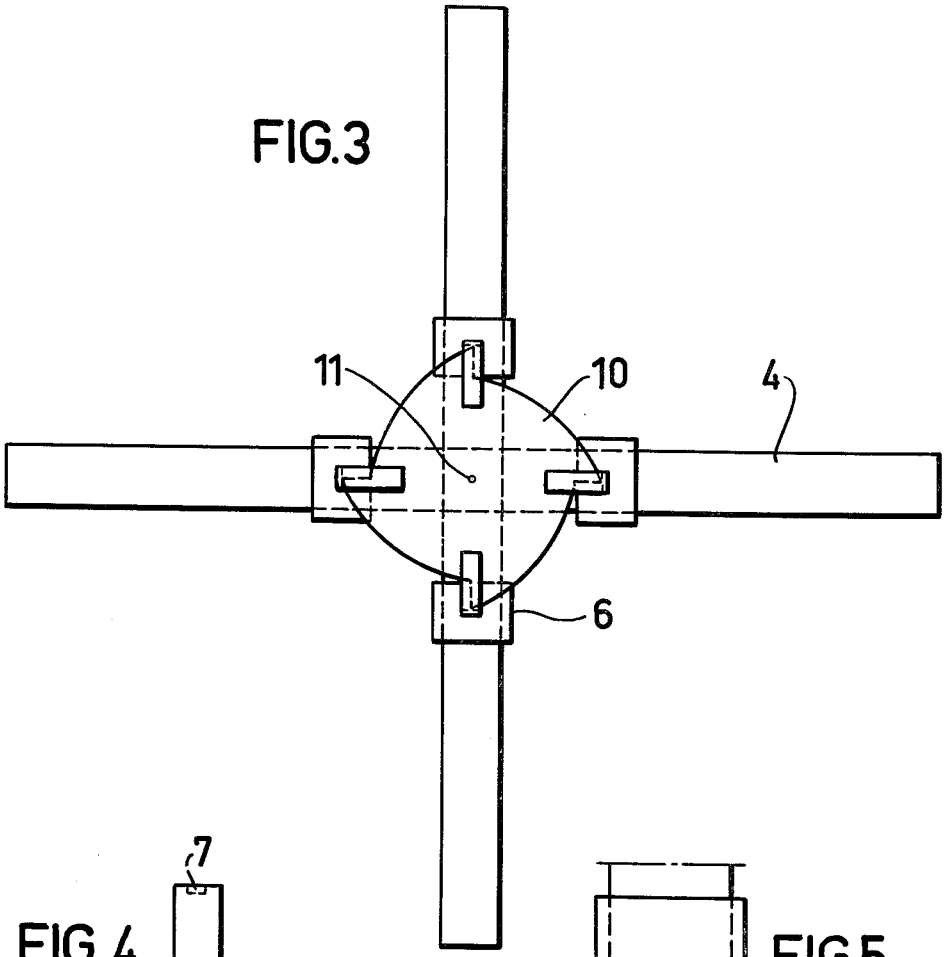
Figure 4:
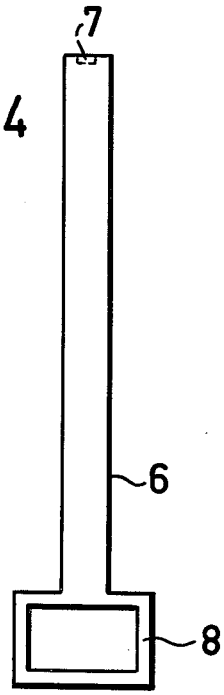
Figure 5:
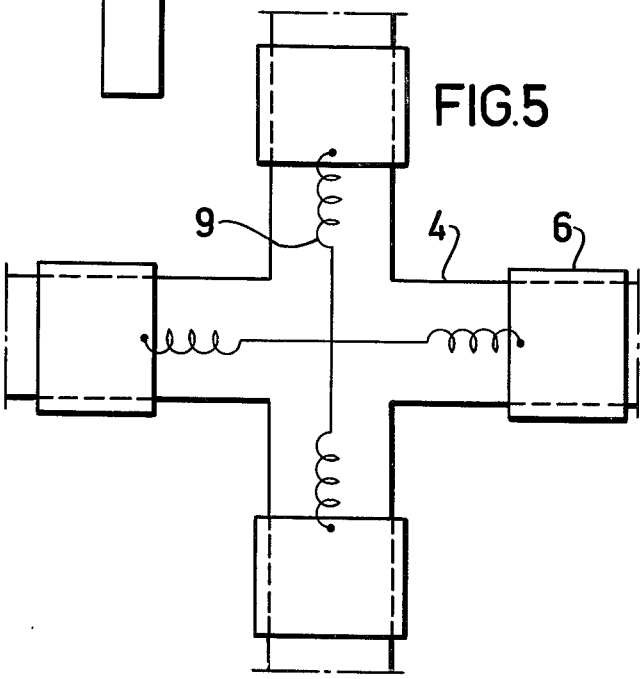

An embodiment of the invention is described in greater detail in the following, with reference to the accompanying drawings, in which FIG. 1 is a section through a Christmas tree base according to the invention, FIG. 2 is a view from above of said base, FIG. 3 is a view from above of the same embodiment, but the details thereof being in a different position, FIGS. 4 and 5 show details of members comprised in the base.

FIG. 1 shows the lower portion 1 of a Christmas tree inserted into the base, so that an upward directed point 2 penetrates into the sawn lower end and forms a moment-receiving hold.

Said hold has the object to fix and center the lower end of the trunk and, or course, may consist in known manner of a conic cup 3, in the bottom of which the trunk is secured more or less by wedging which, however, generally requires a previous sharpening of the trunk. Such a conic cup is indicated in FIG. 1 by a dashed line, and into said cup water may be poured in known manner.

An embodiment advantageous from certain aspects is obtained by combining the water cup at its bottom with a loose plate or a sharpened block with a pin 2. This arrangement offers the advantage that the block follows along when the tree is being lifted out of the base and thereby facilitates the lifting of the tree out of the stand. The block then can be removed easily from the tree by a separate operation. FIGS. 1, 2, 3 and 5 show a base with a stand, which has four legs, but also three and five legs can be imagined. All legs are provided at their outer end with bosses 5 for maintaining the base in a position above floor level. It is hereby possible along the legs 4 of the stand to provide holders or the like, which are movable to and from the stand centre where the lower end of the trunk is fixed by the pin 2 or the like.

A holder member 6 may be designed as shown in FIGS. 1 and 4 where a lower portion 8 in the form of a square tube encloses the stand leg 4 and is movable along the same. An intermediate portion 6 extends upward from said tubular portion 8 and terminates in a portion 7 so designed as firmly to engage with the trunk. FIG. 4 shows such an intermediate portion seen from outside in the direction of the stand legs. Said portion 7 preferably is formed like a hook or the like.

FIGS. 1 and 5 show in a schematic manner how springs 9 are arranged to draw all (in this case four) holders in the direction to the base centre.

By designing each holder sufficiently long (high) and by providing the tubular portion 8 with sufficient tolerance relative to the stand leg 4, a certain self-locking (chest-drawer effect) between the sleeve 8 and the leg is obtained. This self-locking normally has proved sufficient for holding the tree steadily. If, however, the trunk shrinks substantially by drying, a certain play can arise. The springs can be regarded in this respect to be a safety means for re-adjustment, but only a very slight tightening is required, thereby facilitating the fixing and loosening of the tree.

When the tree is to be positioned in the stand, the holders first must be moved apart, which according to the invention is carried out by means of a disc 10 provided with cams, the centre of said disc in FIGS. 1, 2 and 3 being designated by 11. The aforesaid pin 2 can constitute the rotation centre of the disc, or the disc may be arranged so as to centre about the water-cup or the like.

The appearance of the cam disc 10 is shown in FIGS. 2 and 3, where the disc is provided with four cams, one for every leg. When the disc 10 according to these Figures is rotated counter-clockwise, the cams are formed to push the respective holder outward, i.e. in the direction away from the disc centre. In FIG. 2 all holders are shown drawn to the centre by their respective springs, and the holders abut the smallest radius of the cams. When now the disc 10 is rotated counter-clockwise, the holders will be pressed by the cams outward from the centre to the position shown in FIG. 3.

In this position the lower sawn surface of the tree 1 can be positioned on the pin 2 (or in the cup 3). At the structure according to the invention, this positioning does not require special accuracy, because the holders 6 will be drawn inward to the centre until they abut the trunk when the disc 10 then is rotated clockwise, which can be effected by means of the base. It is important in this connection, that the deepest portion of the cams is formed so that there always is a certain play between the disc 10 and the holders 6 when the hooks 7 of the holders abut the trunk 1.

The locking, which implies a certain obliquity between the tubular sleeve 8 on the holder and the stand leg, thus, is released by the springs 9. It is obvious that the springs can be replaced by rubber strings having the same effect. The cam disc 10, of course, may be placed beneath the stand without thereby changing the function of the disc.

The stand according to the invention can be manufactured in a very simple manner, because standard dimensions can be used. The assembly work is so simple that the stand can be sold even as a do-it-yourself kit.

Due to the fact that such a Christmas tree base renders it possible for a single person to provide a Christmas tree with a base, without littering and without having to work hard in uncomfortable positions on the floor, the device according to the invention can contribute to reducing the stress and hurry, which tend to increase from year to year, without discarding the traditional Christmas tree. This may have a certain importance especially for older and lonely persons.

What I claim is:

1. A Christmas tree base or similar holder of the kind where a preferably cross-shaped stand with horizontal legs forms a support against the bearer (floor), where on each leg a slidable holder is provided, which with a tubular portion encloses a leg with a certain play, and springs or the like are arranged to draw the holders to the centre of the stand, which holders are provided with upright means having hooks abutting the trunk or the like, and a central disc provided with cams corresponding in number to the legs of the stand is mounted rotatably in order upon rotation in one direction to engage the holders and to push the holders outward from the centre against the action of said springs, and upon rotation in the other direction to cause the holders to slide inward to the centre by action of said springs, characterized in that the aforesaid play between the respective tubular member and arm is so adjusted, that upon abutment of the upper end of the holder to the trunk or the like the tubular member is positioned obliquely in relation to the arm, so that the trunk effectively is retained by the substantial increase in friction arising by the friction between said member and the stand leg enclosed thereby (chest drawer effect).

2. A Christmas tree base or the like as defined in claim 1, characterized in that in the centre of the stand a pin or the like is provided to fix the lower cut surface of the tree or the like, and that the pin constitutes the centre of rotation for the cam disc.

3. A Christmas tree base or the like as defined in claim 1, characterized in that the centre of the stand is formed as a conic water cup, and the shell surface of the cup is the bearing centre for the cam disc.

4. A Christmas tree base or the like as defined in claim 3, characterized in that a central block with a central upright point is provided to be fitted into the bottom of the cup for co-operation with the lower cut surface of the tree or the like.

5. A Christmas tree stand comprising a base for engaging the lower end of the trunk of a Christmas tree to receive the weight of the tree, a plurality of generally horizontal, support legs extending radially outwardly from the base; a holder associated with each leg, each holder having a lower end portion slidably attached to the respective leg for sliding movement therealong and each holder having an upright portion including a radially inwardly extending part engagable with the tree trunk at a location above the legs, the cooperation between said lower portion of each holder and the respective leg being such that outward tilting of the holder relative to the respective leg results in selflocking of the lower portion thereof to the respective leg due to an increase in friction between the slidably engaged surfaces whereby each holder becomes self-locked when its radially inwardly extending part is pressed against the tree trunk; spring means urging the lower end portions of the holders radially inwardly, and means for releasing the holders from their self-locked positions, said means including a central horizontal disc having a cam surface corresponding to each hold, said disc being mounted for rotation about a vertical axis in order upon rotation in one direction to engage the lower portions of the holders and push same radially outward against the action of the springs thereby unlocking said lower portions of the holders from the legs and upon rotation in the other direction to permit the holders to slide radially inward under the action of said spring means.

6. A stand as in claim 5 wherein said base includes a conic cup coaxial with said disc for receiving the lower end of the tree trunk and further includes an upwardly projecting pin within and coaxial with the cup for engaging and fixing the tree trunk.

7. A stand as in claim 5 wherein said base includes an upwardly projecting pin for engaging and fixing the lower end of the tree trunk, said pin forming the center of rotation of said disc.

* * * * *